United States Patent [19]

Anderson

[11] 4,385,982

[45] May 31, 1983

[54] PROCESS FOR RECOVERY OF BITUMEN FROM TAR SANDS

[75] Inventor: Ardis L. Anderson, Ponca City, Okla.

[73] Assignee: Conoco Inc., Ponca City, Okla.

[21] Appl. No.: 263,631

[22] Filed: May 14, 1981

[51] Int. Cl.[3] ..... C07G 1/00; C07G 1/06

[52] U.S. Cl. ..... 208/11 LE; 208/8 LE; 208/131

[58] Field of Search ..... 208/11 LE, 131, 11 R, 208/8 LE, 8 R

[56] References Cited

U.S. PATENT DOCUMENTS 4,267,031 5/1981 Hirabayashi et al. ..... 208/131 X

FOREIGN PATENT DOCUMENTS 952839 8/1974 Canada ..... 208/11 LE 1094484 9/1977 Canada ..... 208/11 LE

*Primary Examiner*—Delbert E. Gantz

*Assistant Examiner*—A. Pal

*Attorney, Agent, or Firm*—Richard W. Collins

[57] ABSTRACT

Bitumen contained in tar sands is extracted in a primary extraction step which produces a bitumen-containing froth. A hydrogen donor diluent solvent is added to the froth, and the froth-solvent mix is subjected to a desalting operation. A bitumen-solvent product from the desalting step is subjected to a coking operation. In one embodiment, a delayed coker is used, and a gas oil fraction from the coker overhead vapors in hydrogenated and used as the donor solvent in the desalting step.

1 Claim, 1 Drawing Figure

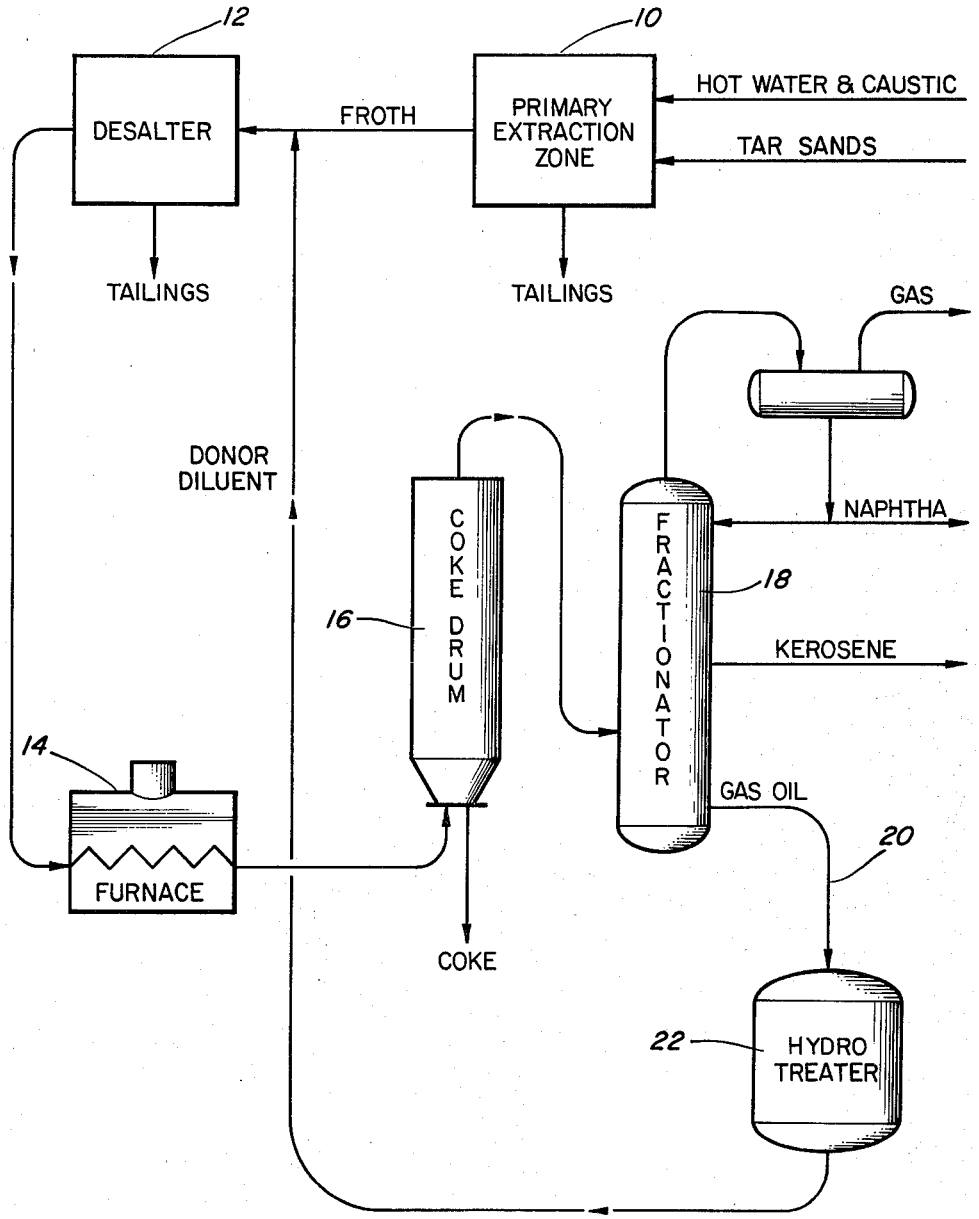
12
10
DESALTER
FROTH
PRIMARY EXTRACTION ZONE
HOT WATER & CAUSTIC
TAR SANDS
TAILINGS
TAILINGS
GAS
DONOR DILUENT
COKE DRUM
FRACTIONATOR
NAPHTHA
18
16
KEROSENE
14
GAS OIL
20
FURNACE
COKE
22
HYDRO TREATER

PROCESS FOR RECOVERY OF BITUMEN FROM TAR SANDS

BACKGROUND OF THE INVENTION

This invention relates to recovery of hydrocarbons from tar sands, and more particularly to an improved process for treating a bitumen-containing froth obtained from a primary extraction step.

There have been many proposed processes for recovering hydrocarbons from tar sands. U.S. Pat. Nos. 3,547,803; 3,553,100; 4,035,282 and 4,098,674 are representative of this group of proposed processes. The prior art processes generally involve a primary extraction step wherein some combination of hot water, steam and caustic is mixed with the tar sand to produce a bitumen-containing froth.

The processes then require some method of separating the hydrocarbon material from the froth by settling, centrifugation or the like. U.S. Pat. Nos. 3,607,721 and 3,901,791 disclose processes for upgrading the froth.

U.S. Pat. No. 3,547,803, previously referred to, discloses adding a diluent to the tar sand before the primary extraction step, and suggests a desalting step to treat recycle diluent after the hydrocarbon products from the tar sands have been recovered.

Finally, there is a commercial tar sands plant operating in Canada which adds a naphtha diluent to the froth followed by centrifugation to remove solids and water from the diluted bitumen. This process requires a distillation step to recover the naphtha diluent.

There has been a continuing search for improved tar sands processes which are effective and energy efficient.

SUMMARY OF THE INVENTION

According to the present invention, tar sand is subjected to a conventional froth-producing primary extraction step, and a hydrogen donor diluent solvent is added to the froth. The diluent-froth mix is then subjected to a desalting step which removes water and suspended solids.

The resulting bitumen and diluent product stream is coked, by either fluidized bed or delayed coking. If delayed coking is used, a gas oil stream from the coker fractionator may be hydrotreated and used as the diluent for the desalting step.

THE DRAWINGS

The FIGURE is a schematic flowsheet illustrating the preferred embodiment of the invention.

DESCRIPTION OF THE PREFERRED EMBODIMENT

The first step in the process of this invention is a conventional primary extraction step wherein some combination of hot water, steam and caustic is agitated with tar sands to produce a bitumen-containing froth. The next step is a departure from conventional processing in that a hydrogen donor diluent solvent, such as a mildly hydrotreated gas oil boiling range hydrocarbon fraction, is added to the bitumen-containing froth. The diluent-froth mix is then subjected to a desalting operation. Demulsifying additives can be used if an emulsion forms which is difficult to break. These generally are of the high molecular weight alkaline earth sulfonates or amine phosphate types.

Desalters are used in processing crude oils to remove brine and suspended solids from the hydrocarbons. Intimately mixed water and hydrocarbons are added to a desalter vessel at moderate pressure and a temperature of from 30+ to 150° C. and are then subjected to a high voltage electrostatic field. Clean desalted hydrocarbons, substantially free of water and suspended solids, are then sent directly to a coking operation. The coking operation can be either fluidized bed or delayed coking, but preferably is delayed coking.

In accordance with a preferred embodiment, overhead vapors from a delayed coker are fractionated, and a gas oil stream from the fractionator is then mildly hydrotreated and subsequently utilized as the hydrogen donor diluent solvent added to the froth.

The preferred embodiment of the invention is illustrated in the Drawing, where tar sands are treated in primary extraction zone 10 by agitation with steam, hot water and caustic. A bitumen-containing froth from zone 10 is then combined with hydrogen donor diluent solvent in an amount of from one to five parts by weight solvent for each part by weight froth and the froth-diluent mix is passed to desalter 12. Brine and suspended solids are separated from hydrocarbons in the desalter, and the hydrocarbons including diluent and extracted bitumen are heated to coking temperature in furnace 14. The heated hydrocarbons are then coked in delayed coking drum 16. Overhead vapors from coke drum 16 are fractionated in coker fractionator 18 and various product streams are recovered. A gas oil boiling range stream from fractionator 18 is taken through line 20 to hydrotreater 22 where it is subjected to moderate hydrotreating conditions and the hydrotreated gas oil is then used as the hydrogen donor diluent solvent added to the froth from primary extraction zone 10.

The process of the invention provides significant advantages over the conventional processes which require large centrifuges to separate water and suspended solids from the bitumen-containing froth. Also, the naphtha recovery step of the prior art is eliminated, and the coke yield is decreased, with resulting increase in liquid products, as a result of coking the combined bitumen-diluent stream rather than coking bitumen after naphtha has been removed as in the prior art.

The essential features of the invention which involve departures from prior art tar sands processes include addition of a hydrogen donor diluent solvent to bitumen-containing froth from a primary extraction zone, subjecting the froth-solvent mix to an electrostatic desalting step, and coking the desalted hydrocarbon stream without first removing the diluent.

The foregoing description is intended to be illustrative rather than limiting of the invention. It will be apparent that numerous variations and modifications to the process as described could be utilized without departing from the invention, which is defined by the appended claims.

I claim:

1. A process for recovering bitumen from tar sands comprising:

(a) subjecting tar sands to a primary extraction step;

(b) recovering a bitumen-containing froth from said primary extraction step;

(c) adding a hydrogen donor diluent solvent to said froth;

(d) subjecting said froth and added hydrogen donor diluent solvent to a desalting step;

(e) passing bitumen and hydrogen donor diluent solvent from said desalting step to a delayed coking operation;

(f) recovering overhead vapors from said delayed coking operation and fractionating said vapors;

(g) recovering a gas oil fraction from said fractionating step;

(h) hydrotreating said gas oil fraction to produce a hydrogen donor diluent solvent; and (i) utilizing said hydrogen donor diluent solvent as the solvent added to said froth in step (c).

* * * * *